United States Patent [19]

Best et al.

[11] Patent Number: 4,895,413

[45] Date of Patent: Jan. 23, 1990

[54] CUTTER ROLLER WITH SPRAYING NOZZLE

[75] Inventors: Gerd Best, Sprockhovel; Norbert B. Weikert, Dortmund, both of Fed. Rep. of Germany

[73] Assignee: Dipl.-Ing. Rudi Beyer, Bezirk Dusseldorf, Fed. Rep. of Germany

[21] Appl. No.: 94,589

[22] Filed: Sep. 9, 1987

[30] Foreign Application Priority Data

Sep. 9, 1986 [DE] Fed. Rep. of Germany ..... 3630636

[51] Int. Cl.[4] ..... F21C 7/08; F21C 35/22

[52] U.S. Cl. ..... 299/81; 175/424

[58] Field of Search ..... 299/79, 81, 12, 17; 175/339, 340, 393, 424

[56] References Cited

U.S. PATENT DOCUMENTS

| | | | |
|---|---|---|---|
| 733,372 | 7/1903 | Colwell | 137/71 |
| 1,348,708 | 8/1920 | Garland | 137/68.1 |
| 4,219,239 | 8/1980 | Weikert et al. | 299/81 |
| 4,498,707 | 2/1985 | Best et al. | 299/81 |
| 4,534,597 | 8/1985 | Kemper | 299/81 |
| 4,569,558 | 2/1986 | Hood | 299/17 X |

FOREIGN PATENT DOCUMENTS

| | | | |
|---|---|---|---|
| 1126766 | 6/1982 | Canada . | |
| 0010534 | 7/1982 | European Pat. Off. . | |
| 7917606 | 9/1979 | Fed. Rep. of Germany . | |
| 2946661 | 5/1981 | Fed. Rep. of Germany | 299/81 |
| 3102884 | 8/1982 | Fed. Rep. of Germany . | |
| 621873 | 8/1978 | U.S.S.R. . | |
| 717326 | 2/1980 | U.S.S.R. | 299/81 |
| 2077813 | 12/1981 | United Kingdom | 299/81 |

*Primary Examiner*—Bruce M. Kisliuk
*Assistant Examiner*—David J. Bagnell
*Attorney, Agent, or Firm*—Antonelli, Terry & Wands

[57] ABSTRACT

A cutting arrangement which includes a cutting roller whereby a spray liquid supply is controlled by a forces acting on the cutting roller. The cutting roller includes a nozzle holder which functions to inhibit or block the flow of the spray liquid and, when the roller cutter or cutting blade is in operation, a deflecting spring element causes the nozzle holder to tilt thereby releasing a spray liquid to the spraying nozzle.

7 Claims, 2 Drawing Sheets

CUTTER ROLLER WITH SPRAYING NOZZLE

BACKGROUND OF THE INVENTION

The present invention relates to a cutter roller and, more particularly, to a cutter roller provided with spraying nozzles each of which are individually arranged in a nozzle holder, with each nozzle holder being in communication with a connecting duct for a spraying liquid and a spray liquid supplied to the respective nozzles being controlled by forces acting upon the cutter during a cutting operation.

In, for example, German Pat. No. 3,302,103, a cutter roller provided with spraying nozzles is proposed wherein each nozzle is individually located in a nozzle holder, with the nozzle holder being connected to a connecting duct for spraying a liquid. During a normal operation of the cutter roller, the nozzle holder is connected to a shut-off valve which is always open but which, after having completely removed the spraying nozzle, automatically assumes a closed position in its liquid compressor.

In the above proposed construction, the spraying nozzle is positioned with a rear cylindrical section butting against an inhibiting element which is maintained in an open position in a longitudinal direction of the spraying nozzle against a resetting force of a compression spring, whereby the compression spring is supported on a front face thereof which faces away from the inhibiting element against a counter bearing which is permanently connected to the nozzle holder. A cartridge-shaped or cylindrical nozzle connector provided with an external thread, is threadably secured in a boring in a helix or similar manner and, in conjunction with the spraying nozzle, the shut-off valve forms a complete armature-type structural component which also can be exchanged.

By virtue of the fact that each spraying nozzle in the above described arrangement is correlated to a shut off valve which automatically operates, it is ensured that, in the event the spraying nozzle is not deflected, none of the spray liquid can escape from the respective duct openings. The automatic operating shut off valve is always in a state of operational readiness and becomes instantly operative in the event that any of the spraying nozzles may, for example, be broken or displaced out of their mounting. In such situations, the inhibiting or blocking element immediately closes the duct which is correlated to the respective spraying nozzle so that it is ensured that the spray liquid can not escape without having been used. This proposed construction is not expensive and, when compared to usual constructions, it provides an arrangement whereby the cutter roller does not have to be changed and the nozzle holder does not have to be welded in place but rather can be threadably inserted thereby facilitating the very quick change of the nozzle if such becomes necessary. Moreover, the components of the proposed arrangement are not exposed to any thermal stress.

In, for example, German No. DE-GM 79 17 606, a further spraying nozzle for cutter rollers is proposed which includes a nut-type housing which has a centrally-drilled hole on a water outlet side thereof and a collecting bore on the water inlet side which can be threadably inserted into a duct. A fitting in which a hole has been provided is provided on the water side and is pressed inside the collecting bore and a spray chamber is located between the central bore and the fitting. This arrangement provides a feasible way of suppressing dust by efficient nozzles as well as resulting in a reduction in time and costs when the roller is either to be repaired or during a down time necessary for cleaning the water nozzles.

In EP-PS No. 0 010 534, a device for cooling a cutting tool of a cutting machine at a cutting face as well as for suppressing dust is proposed with the cutting tool including at least one rotating cutting head on an articulated cutting arm of a cutting machine whereby the cutters are only periodically in contact with the workpiece to be cut. A control system is proposed which only releases a supplying of the cooling medium to the nozzle during the actual time when the cutter nozzles are in operation which are correlated to the respective nozzles. By such an arrangement, the water which is used as the cooling medium is to be used without adding any air whereby the cutter shaft o the cutter supported in the cutter holder in such a manner that it can be axially moved and is spring mounted against the cut and the control of the supply of the cooling medium is effected by a pushing movement of an admission valve of the cutter holder. The cutter holder is provided with a radially projecting shoulder which operates in conjunction with a tappet operable to open the valve An operating means for the valve body includes a sealing piston equipped with a projection which is adapted to effectively operate upon the valve body.

A construction comparable to the last proposed arrangement is also disclosed in Canadian Pat. No. 1,126,766; however, the proposed construction is extremely expensive and is hardly suitable for uninterrupted operation during rough mining conditions.

The air underlying the present invention essentially resides in providing an improved cutting roller having a plurality of spray nozzles each of which is arranged individually in a nozzle holder, with each nozzle holder being correlated to a connecting duct accommodating a spray liquid and supplying the spray liquid to the respective spray nozzles, with the supply being controlled in response to forces acting upon the respective cutter when carrying out a cutting operation. By virtue of the features of the present invention, it is possible to take into account the stresses which develop at the respective cutter during the cutting operation and utilizing the same at least to control an opening of a supply of the spray liquid to a spraying nozzle.

In accordance with advantageous features of the present invention, a cutter roller with spraying nozzles is provided wherein the nozzle holder also functions at the same time as a blocking or inhibiting element for the supplying of spray liquid to the spraying nozzle and at least one spring element is correlated to the respective cutter and operates the nozzle holder either in a spray liquid "open" or in a spray liquid "closed" position.

By virtue of the features of the present invention, the nozzle holder itself also functions as a shut off component and, consequently, it is no longer necessary to provide for any special shut off fittings or other shut off arrangements.

Moreover, by virtue of the features of the present invention, either the cutter or the shaft of the cutter controls the nozzle holder by virtue of the provision of at least one spring element such as, for example, a Belleville spring washer, whereby the nozzle holder can be used as an element for transferring the movements of the cutter when being subjected to stresses due to the cutting operation which are transferred by the spring element to the nozzle carrier which is then controlled in dependence upon the stresses developing during the cutting operation.

Advantageously, the spring element of the present invention may, for example, be disposed beneath a shoulder of a shaft of the cutter or a portion of the cutter itself and, all that is required is a relatively sturdy commercially available component such as a Belleville spring washer which is utilized as a transfer mechanism between the cutter and the nozzle holder to, for example, cause the nozzle holder to open when, for example, a rock or some other material is contacted thereby enabling the spraying of the spray liquid to reach the spraying nozzle.

In accordance with further advantageous features of the present invention, the spray duct accommodating the spraying liquid is connected by way of, for example, a triangular shaped flow chamber along an axial longitudinal section which extends in parallel to the longitudinal axis of the nozzle holder to which the spraying nozzle is connected in such a manner so as to enable liquid to flow therethrough.

By virtue of a provision of a triangular flow chamber and the above noted additional features, a relatively small tilting movement of the nozzle holder results in a relatively large free somewhat triangularly shaped chamber so that the spray fluid can flow in a very quick manner and, for all practical purposes, instantaneously, through a longitudinal duct of the nozzle holder up to the spray nozzle itself.

The nozzle holder may, in accordance with the present invention, be pivotally mounted so that it is possible to enable the nozzle holder to react or reset to a resetting force of at least one spring element. By virtue of these features, it is ensured that the resetting o the nozzle holder, namely, the returning to the closed position, occurs by the spring element after the forces have ceased to act upon the respective cutter.

Advantageously, according to the present invention, the spring element such as, for example, a Belleville spring washer, is adapted to be brought into abutting engagement against a shoulder of the cutter and changes its diameter when forces act on the cutter thereby tilting the nozzle holder in an opening direction movement while being supported on a sealing face of a valve seat.

Accordingly, it is an object of the present invention to provide a cutter roller equipped with spraying nozzles which avoids, by simple means, shortcomings and disadvantages encountered in the prior art.

Another object of the present invention resides in providing a cutter roller with spraying nozzles which is sturdy, lightweight, and utilizes individual components which can be manufactured at a reasonable cost.

A still further object of the present invention resides in providing a cutter roller with spraying nozzles which is adapted to rough working conditions to which cutter rollers are subject and, in particular, to cutting conditions which occur in underground coal mining.

These and other objects, features, and advantages of the present invention will become more apparent from the following description when taken in connection with the accompanying drawings which show, for the purposes of illustration only, one embodiment in accordance with the present invention.

DETAILED DESCRIPTION

Figure 1:
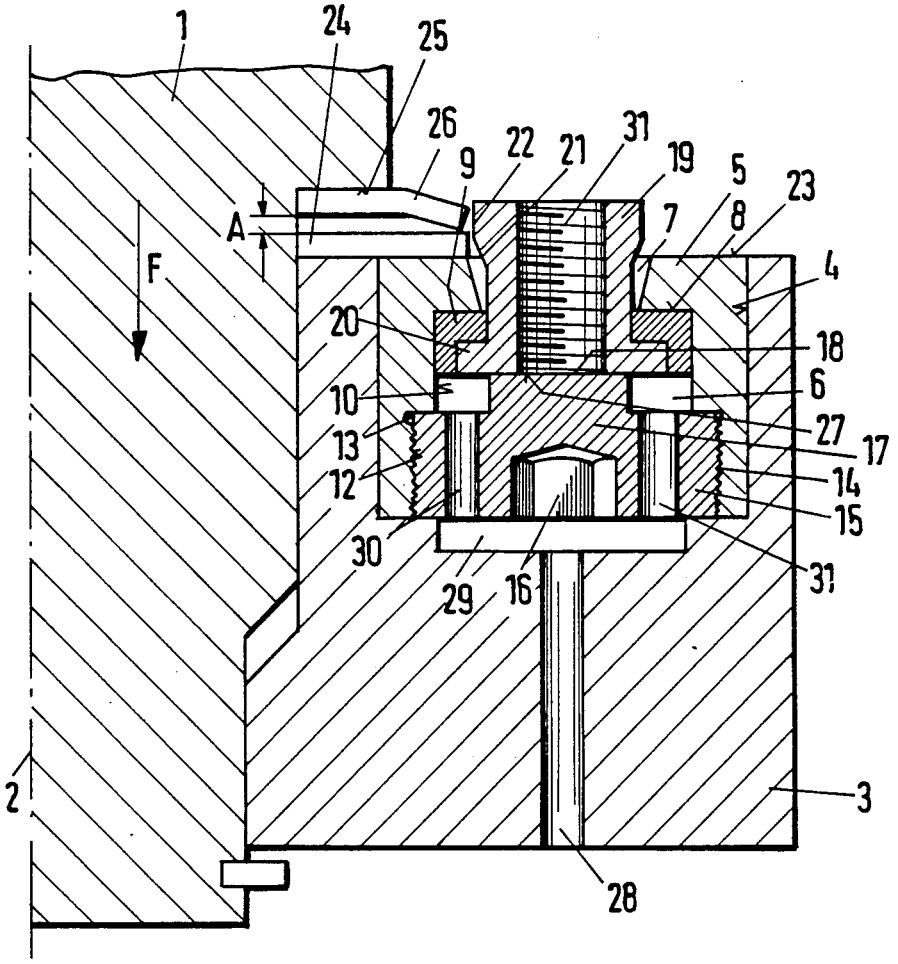
FIG. 1 is a partial longitudinal cross-sectional view of a cutter roller with spraying nozzles constructed in accordance with the present invention.

Referring now to the drawings wherein like reference numerals are used in both views to designate like parts and, more particularly, to FIG. 1, according to this figure, a cutter 1, having a center line 2 is provided with a force acting in a direction of the arrow F developing in the cutter 1 during the cutting operation. A cutter holder 3 is provided with a cutout or opening 4 for accommodating a housing 5. The housing 5 is fixedly secured in the cut out 4 by, for example, welding, force fit, or suitable fastening means or by cooperable threaded portions of the housing 5 and the cutout or opening 4. The housing 5 includes a chamber 6, in communication with a chamber 7 by an orifice. The chamber 7 has a conical configuration extending in an outward direction and has a reduced diameter or cross section as compared to a chamber 6 so as to form an annular shoulder 8 for supporting a spring element 9. The spring element 9 may be formed, for example, as a cup or pot-shaped seal element, with circumferential outer walls of the spring element 9 being supported in abutment against an inner wall of a cylinder 10.

The chamber 6 is connected by an orifice to an extended diameter chamber 12 provided with a hollow throat 13, with the chamber 12 being provided with a threaded portion 14 for threadably accommodating a plug-shaped valve shaped valve seat 15. The plug-shaped valve seat 15 may, as shown in FIG. 1, be provided with a means for facilitating a threadable insertion of the valve seat 15 into the chamber 12, with such means being formed, for example, as a hexagonal socket 16 for accommodating a suitable tool (not shown).

The valve seat 15 is provided with a central valve projection 17 adapted to be brought into abutment with a sealing face 18 of a nozzle holder or carrier 19 so as to form a sealed interface in order to threadably accommodate, for example, a threaded spraying nozzle (not shown).

The nozzle holder or carrier 19 includes a rotary component having a circular flange 20 which is encircled or surrounded by at least one spring element 9.

A portion of an axial length of the nozzle holder or carrier 19 has a substantially cylindrical configuration and a transition portion formed by a conical section 21 into a diametrically increased cylindrical shaped section 22. In FIG 1., the increased cylindrical shaped section 22 is illustrated as being somewhat smaller in diameter than the outer diameter of the annular flange 20; however, as can be appreciated, the diameter of the increased cylinder section 22 may be equal to or larger than the diameter of the annular flange 20.

As also shown in FIG. 1, the nozzle carrier or holder 19 extends axially outwardly beyond a front or top face or surface 23 of the housing 5, with a portion of the conically shaped longitudinal section 21 and cylindrically shaped longitudinal section 22 from the conical chamber 7.

An upper or front face 23 of the housing 5 has a wear resistant surface cooperable with a wear resistant plate member 24 which lies on the cutter holder 3 and an upper surface of the housing 5. The wear resistant plate 24 terminates at an end opposite the cutter 1 at a position substantially corresponding to a point at which the conical chamber 7 merges or joins with the front face 23 of the housing 5.

The roller cutter 1 or a shaft portion thereof includes a shoulder 25, with the spring element 26, such as, for example, a Belleville washer, being in abutment with the shoulder 25. It is also possible in accordance with the present invention to provide a plurality of spring elements 26 depending upon the particular circumstance or use of the roller cutter. The spring element 26 has a circumference which is approximately equal to a circumference of the wear resistant element 24.

Figure 2:
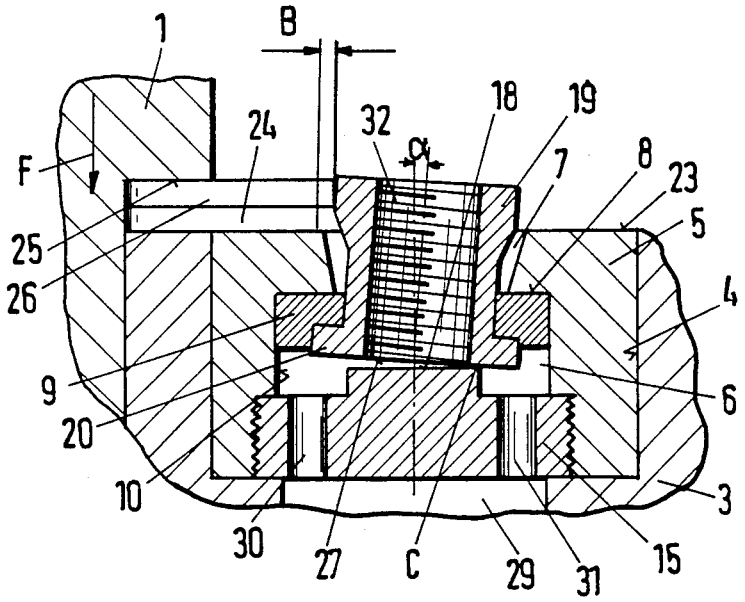
FIG. 2 is a cross-sectional detail view, on an enlarged scale, of the cutter roller of FIG. 1 with the spraying nozzle holder in an open position.

As shown in FIG. 1, in a non-loaded condition, a gap A is provided between the spring element 26 and the wear resistant plate 24. If a force is applied in the direction of the arrow F to the roller cutter 1, the spring element 26 is reflected as shown in FIG. 2 and is pressed so as to be substantially flat thereby resulting in an increase in a diameter, namely, in the amount of the dimension illustrated B in FIG. 2. This causes the spring element 26 to tilt at an angle $\alpha$ which displaces the nozzle carrier or holder 19 from the front face or surface 27 of the valve seat 15. Thus, the point or the line acts practically as a fulcrum or an articulated joint as shown in FIG. 2 so that a triangular flow chamber, shown most clearly in FIG. 2 is formed between the sealing face 18 and the front face 27 and, by way of a spray nozzle (not shown) can be connected through a supply liquid duct 28 which flows into a distribution chamber 29 through a plurality of ducts 30, 31.

More than two ducts may be provided if necessary and may be arranged either evenly or unevenly along the periphery of the valve seat 15, with the ducts 30, 31 emptying into a chamber 6 so that, when tilting the nozzle holder 19 over a relatively large cross sectional flow, the spray liquid supply duct 28 can be connected through the distribution chamber 29 and the ducts 30 and 31 as well as the chamber 6 in such a manner so as to cause a favorable flow to a duct 31 which coaxially leads through a nozzle chamber 19 resulting in the spraying nozzles (not shown) being instantaneously supplied without any or very little resistance to the spray fluid.

If the force indicated by the arrow F is no longer applied, the spring element 26 returns to a position shown in FIG. 1 thereby resulting in a tilting force no longer being applied through the spring element 26 to the nozzle holder or carrier 19 so that the nozzle holder or carrier 19 is moved rearward by the spring element 9 into the starting position illustrated in FIG. 1, wherein the spray liquid duct 28 is sealed off from the spraying nozzle. This means that the spraying nozzle is then only connected to the spray liquid duct 28 when the associated roller cutter 1 actually starts to cut into, for example, a mineral such as coal or the like thereby reducing the consumption of the spray liquid and increasing the overall economy of the operation of the roller cutter 1.

As can be appreciated, the above described elements of the invention may be exchanged without any particular problem since all that is involved are free relatively sturdy individual components which can be handled relatively easily without having to resort to the use of special tools.

While we have shown and described only one embodiment in accordance with the present invention, it is understood that the same is not limited thereto but is susceptible to numerous changes and modifications as apparent to one of ordinary skill in the art and we therefore do not wish to be limited to the details shown and described herein, but intend to cover all such modifications are encompassed by the scope of the appended claims.

We claim:

1. A cutter arrangement comprising at least one cutter roller means and a plurality of individually arranged spraying nozzle means for spraying a liquid on the cutter roller means, a nozzle holder means for accommodating the individual spraying nozzle means, duct means for accommodating the spray liquid and supplying said spray liquid to the respective spraying nozzle means, means for controlling an operation of the respective spraying nozzle means in response to forces applied to the cutter roller means during a cutting operation including means for preventing a supply of the spray liquid to the spraying nozzle means, and at least one spring means associated with the cutter roller means and adapted to tilt the nozzle holder means with respect to a longitudinal center axis thereof so as to enable the nozzle holder means to be displaced to an open position for spraying the spray liquid or a closed position blocking a flow of the spray liquid.

2. A cutter arrangement according to claim 1, wherein the duct means includes a spray liquid duct connected through a triangular flow-chamber extending along an axial longitudinal direction of the spraying nozzle means, said spray liquid duct extending in a longitudinal direction of the nozzle holder means and being adapted to communicate with a spraying nozzle means so as to enable a liquid to flow therethrough.

3. A cutter arrangement comprising at least one cutter roller means and a plurality of individually arranged spraying nozzle means for spraying a liquid on the cutter roller means, a nozzle holder means for accommodating the individual spraying nozzle means, duct means for accommodating the spray liquid and supplying said spray liquid to the respective spraying nozzle means, means for controlling an operation of the respective spraying nozzle means in response to forces applied to the cutter roller means during a cutting operation including means for preventing a supplying of the spray liquid to the spray nozzle means, said means for controlling includes at least one spring means associated with the cutter roller means and adapted to control a nozzle holder means so as to enable the nozzle holder means to be displaced to an open position for spraying the spray liquid or a closed position blocking a flow of the spray liquid, and wherein the nozzle holder means is pivotally mounted so as to enable a displacement thereof by a resetting force of said at least one spring means.

4. A cutter arrangement comprising at least one cutter roller means and a plurality of individually arranged spraying nozzle means for spraying a liquid on the cutter roller means, a nozzle holder means for accommodating the individual spraying nozzle means, duct means for accommodating the spray liquid and supplying said spray liquid to the respective spraying nozzle means, means for controlling an operation of the respective spraying nozzle means in response to forces applied to the cutter roller means during a cutting operation including means for preventing a supplying of the spray liquid to the spraying nozzle means, said means for controlling includes at least one spring means associated with the cutter roller means and adapted to control the nozzle holder means so as to enable the nozzle holder means to be displaced to an open position for spraying the spray liquid or a closed position blocking a flow of the spray liquid, wherein the at least one spring means includes a Belleville spring washer, the roller cutter means is provided with a shoulder portion against which said spring washer abuts, said spring washer being adapted to change a diameter thereof when forces act on the roller cutter means so as to tilt the nozzle holder means in an opening direction while being supported on said means for preventing a supplying of spraying liquid to the spraying nozzle means.

5. A cutter arrangement according to claim 4, wherein a housing means is provided for accommodating said nozzle holder means, said housing means including a shoulder portion, said nozzle holder means includes a flange portion and wherein a further spring means is interposed between said flange portion of said nozzle holder means and said shoulder portion of said housing means.

6. A cutter arrangement according to claim 5, wherein said further spring means is fashioned as a cup-shaped sealing element.

7. A cutter arrangement comprising at least one cutter roller means and a plurality of individually arranged spraying nozzle means for spraying a liquid on the cutter roller means, a nozzle holder means for accommodating the individual spraying nozzle means, duct means for accommodating the spray liquid and supplying said spray liquid to the respective spraying nozzle means, means for controlling an operation of the respective spraying nozzle means in response to forces applied to the cutter roller means during a cutting operation including means for preventing a supplying of the spray liquid to the spraying nozzle means, said means for controlling includes at least one spring means associated with the cutter roller means and adapted to control the nozzle holder means so as to enable the nozzle holder means to be displaced to an open position for spraying the spray liquid or a closed position blocking a flow of the spray liquid, a housing means for accommodating said nozzle holder means, said housing means including a shoulder portion, said nozzle holder means includes a flange portion, a further spring means interposed between said flange portion of said nozzle holder means and said shoulder portion of said housing means, said further spring means includes a cup-shaped sealing element, and wherein a holding means is provided for holding said cutter roller means, said holding means including means for accommodating said housing means.

* * * * *